US005609166A

United States Patent [19]

Walker

[11] Patent Number: 5,609,166

[45] Date of Patent: Mar. 11, 1997

[54] DEVICE FOR REMOVING ARTIFICIAL FINGERNAILS

[76] Inventor: Alvin M. Walker, 143 Lake Shore Dr. North, Palm Harbor, Fla. 34684

[21] Appl. No.: 523,331

[22] Filed: Sep. 5, 1995

[51] Int. Cl.[6] ..... A45D 29/00

[52] U.S. Cl. ..... 132/73; 132/75; 132/73.5; 132/75.3; 15/104.92; 15/167.3

[58] Field of Search ..... 132/73, 75, 73.5, 132/75.3; 15/104.92, 167.3, 187, 188; 401/10, 122, 183, 196; 206/209, 209.1

[56] References Cited

U.S. PATENT DOCUMENTS

| | | | |
|---|---|---|---|
| 597,729 | 1/1898 | Mitchell | 15/104.92 |
| 4,819,672 | 4/1989 | Walker et al. | 132/75 |
| 4,965,906 | 10/1990 | Mauro | 15/104.92 |
| 5,048,547 | 9/1991 | Walker | 132/75 |
| 5,454,131 | 10/1995 | Mackenzie | 15/104.92 |

*Primary Examiner*—Gene Mancene
*Assistant Examiner*—Pedro Philogene
*Attorney, Agent, or Firm*—John S. Hale; Gipple & Hale

[57] ABSTRACT

A fingernail removing device adapted to remove artificial fingernails from the fingers of a user comprising a plastic integrally molded rectangular container body with an inner bristle housing secured and supported by a plurality of integral rib members to the rectangular container body. The inner bristle housing has an oblong configuration defining a chamber with an opening of sufficient width to receive a plurality of fingers with one wall of said bristle housing containing a sectioned flexible brush assembly integrally molded to the inner surface of said wall. The flexible brush assembly comprises at least two separated sections of bristles, each section of bristles comprising a plurality of spaced bristle members extending inward from the inner surface of the bristle housing wall into said chamber and defining a curved passageway allowing plurality of fingers to pass therethrough while allowing the fingers to engage said bristle members, and a cover removably mounted to the container.

19 Claims, 3 Drawing Sheets

Fig. 6
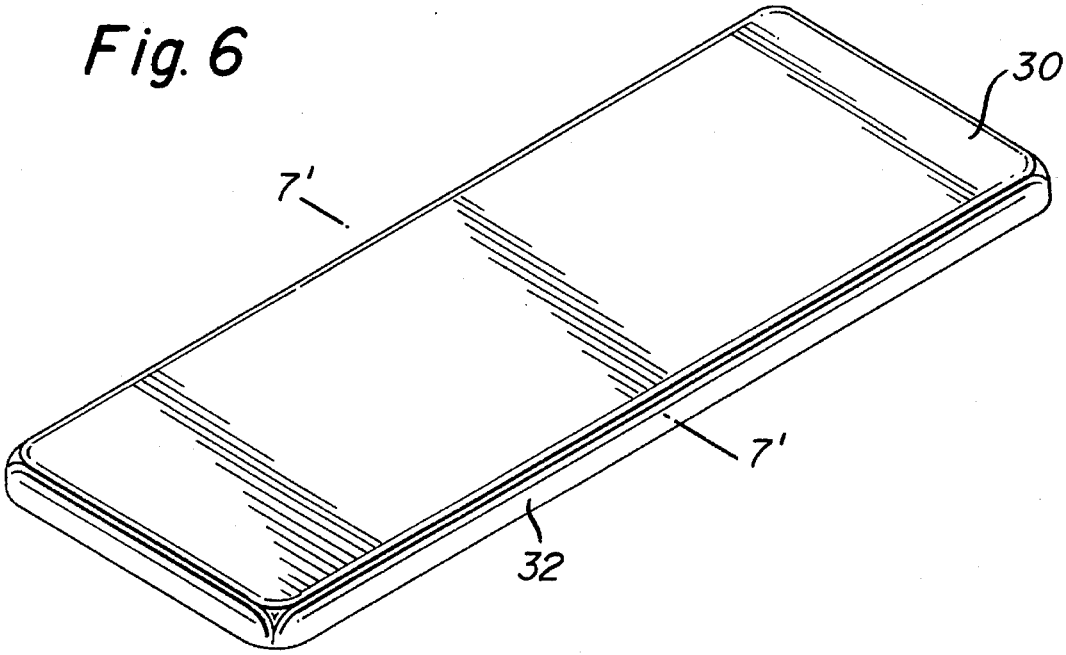
Fig. 7
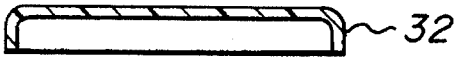
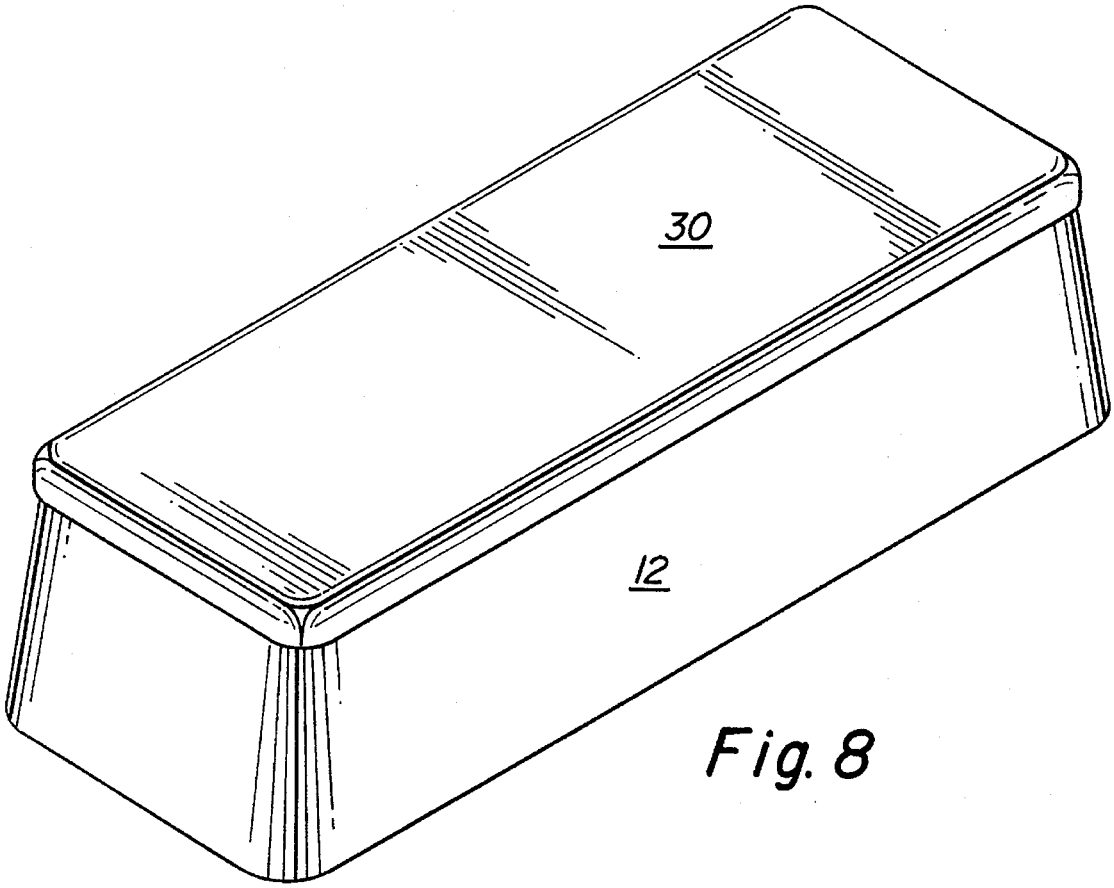
Fig. 8

DEVICE FOR REMOVING ARTIFICIAL FINGERNAILS

BACKGROUND OF THE INVENTION

1. Field of the Invention

The present invention relates to finernail polish removers and in particular relates to an integrally molded device suitable for removing artificial fingernails.

2. Description of the Prior Art

The prior art contains many patents directed to nail polish removal receptacles which support or suspend an insert structure to aid in the removal of hardened nail polish from fingernails after the finger has been immersed into nail polish remover contained within the receptacle. U.S. Pat. Nos. 4,474,195; 4,440,181 and 4,282,891 disclose nail polish remover devices in which a receptacle is provided with a sponge or sponge-like absorbent member insert. The sponge member insert is provided with an aperture forming a finger hole into which the finger is placed. The absorbent sponge absorbs nail polish remover and upon insertion of the finger into the sponge aperture, the polished fingernail comes into contact with the sponge and nail polisher remover solution to remove the polish from the nail. The solution and polish fragments are wiped from the inserted fingernail by the sponge as the fingernail is removed from the receptacle jar. A multi-layered foam surgical scrub sponge similar to those noted above is shown by U.S. Pat. No. 4,866,806. In this reference a removable serrated insert is accommodated in the center of the sponge to enable insertion of the fingers to cleanse and disinfect the cuticle areas.

U.S. Pat. No. 4,480,351 discloses a surgical scrub brush provided with two sets of brushes on each side of the molded body. On one side of the brush the bristles are formed with a configuration of smaller bristles being disposed in a longitudinal channel or gap between taller bristle groups whose tips are laterally exposed to facilitate nail cleaning. The individual bristle members have a triangular cross-section.

U.S. Pat. No. 3,966,335 discloses a surgical scrub brush featuring four bristle-lined troughs for simultaneous scrubbing of the four fingers. Rows of relatively short stiffer bristles are used for cleaning the finger tips, nails and under the nails.

U.S. Pat. No. 4,397,324 discloses a nail polish receptacle which is provided with a brush member. The brush member is disposed in the receptacle by wire legs which support the brush element in the approximate determinus of a circular finger opening. U.S. Pat. No. 4,321,931 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. After a number of uses, the legs tend to spread apart so that a person can get a fingernail caught on the end of the leg, breaking the nail or a portion of the nail during the brushing motion. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position.

U.S. Pat. Nos. 5,048,547 and 4,819,672 disclose cylindrical housing holding a one piece brush assembly which has inwardly projecting integral triangular shaped bristles configured to receive a finger and remove the fingernail polish.

It can thus be seen from the aforenoted patents that they do not teach or show the present invention which utilizes an integrally molded device which provides a simple means of removing artificial fingernails through the removal of several fingernails at one time in a clean relatively free bacteria and virus environment with a minimum of bristle engagement with the finger cuticles.

SUMMARY OF THE INVENTION

The present invention provides for a unique single piece injected molded unit which provides for artificial fingernail removal or fingernail cleaning and conditioning through the use of a molded brush bristle assembly which cleans all four fingers of the hand and removes artificial nails attached to the fingernails. The finger nail remover container has integral flexible bristles positioned in a spaced relationship for maximum interaction with the fingernails.

The bristles are positioned in a fixed relationship to eliminate catching of the bristles on the fingernail when the finger is inserted into the brush member. The bristle members are spaced in bristle rows which are separated to minimize cuticle engagement by the bristles while allowing a constant flow of nail remover into the brushing area during the brushing period and continuous circulation of the liquid throughout the container. The container can be readily cleaned or sterilized to remove any bacterial or viral growths as well as any nail and/or cuticle material that may have been torn or pulled off by the brush. This is of particular importance where the cuticle area may be open and/or bleeding due to job related tearing of the cuticles or simply fingernail biting or picking. Such open wound areas could provide transmission of dangerous virus such as aids.

These and other objects, advantages and novel features of the present invention become apparent when considered with the teachings contained in the detailed disclosure along with the accompanying drawings.

BRIEF DESCRIPTION OF THE DRAWINGS

FIG. 6 is a perspective view of the cover used with the receptacle of FIG. 1;

FIG. 7 is a cross sectional view of the cover shown in FIG. 6 taken along line 7'—7'; and FIG. 8 is a perspective view of the nail polish remover assembly.

DETAILED DESCRIPTION OF THE PREFERRED EMBODIMENT

Figure 1:
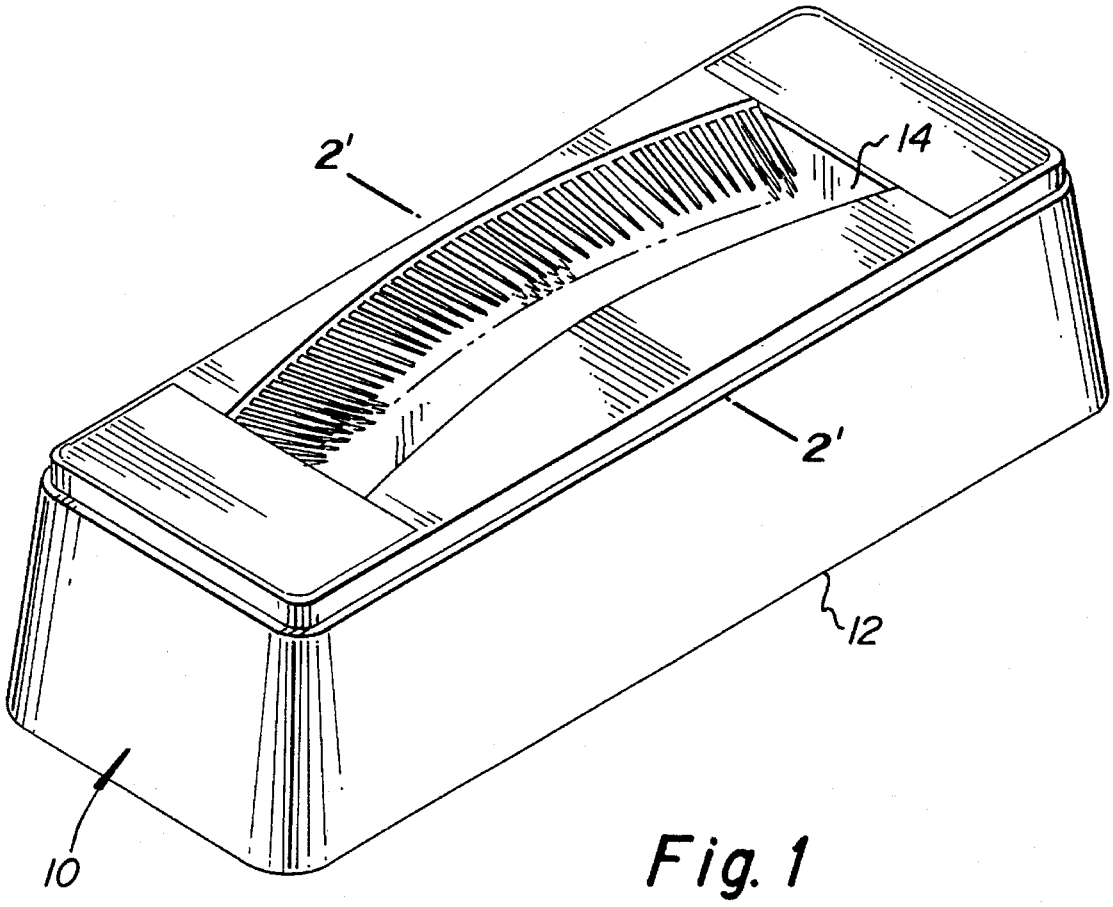
FIG. 1 is a perspective view of the nail polish remover receptacle of the present invention with cover removed.
Figure 2:
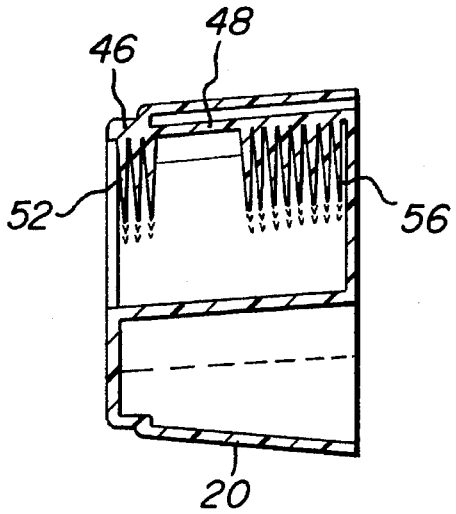
FIG. 2 is a cross-sectional view of the nail polish remover receptacle shown in FIG. 1 taken along lines 2'—2'.
Figure 3:
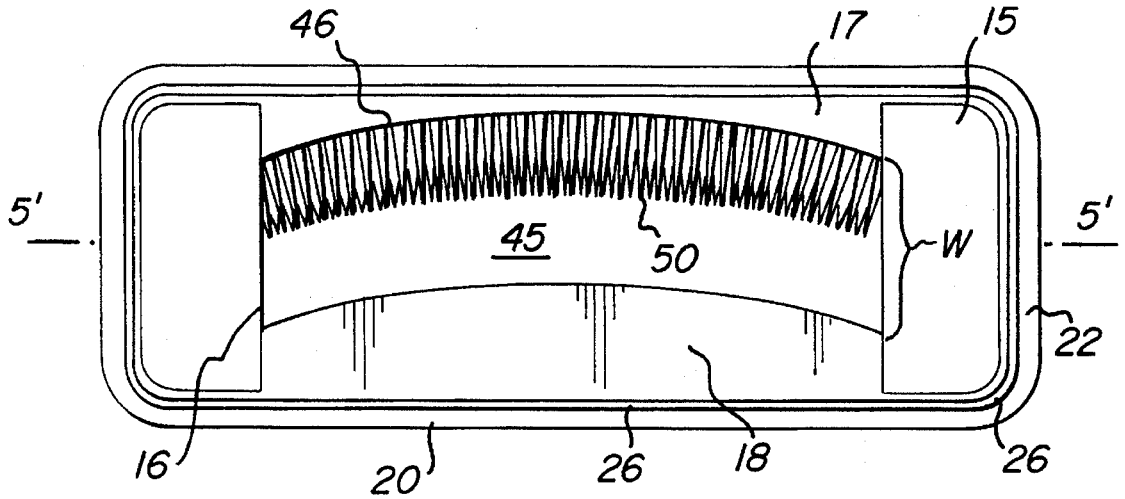
FIG. 3 is a top plan view of the receptacle shown in FIG. 1.
Figure 4:
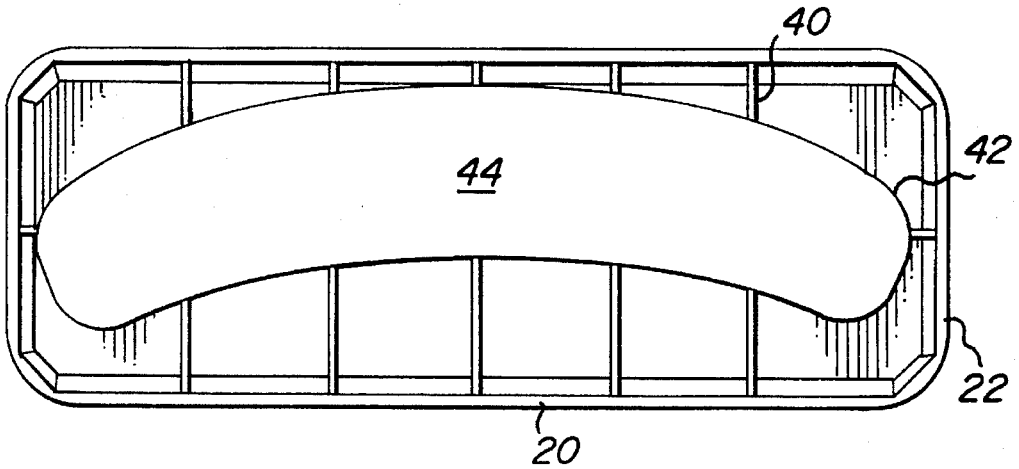
FIG. 4 is a bottom plan view of the receptacle shown in FIG. 1.
Figure 5:
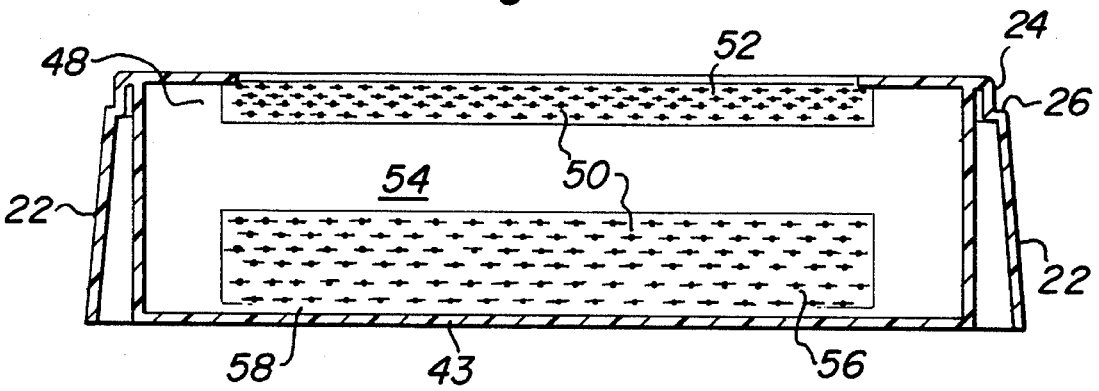
FIG. 5 is a cross section view of the receptacle of FIG. 3 taken along lines 5'—5' with the brush bristles schematically shown.

The preferred embodiment and best mode of the invention is shown in FIGS. 1 through 8. As shown in FIG. 1, the container is generally designed as 10 and comprises a rectangular plastic receptacle 12 having an arcuate shaped opening 14 leading to the brush chamber and removal solution with side panels 15 on the top of the receptacle defining the parallel side walls 16 of the opening 14. The side panels 15 together with the molded top surface areas 17 and 18 form the top surface of the receptacle 12 as well as define the opening 14. The side panels 15 are preferably separate pieces which are secured to the top of the receptacle body by heat sealing the same together through sonic or other thermal means well known in the art. The side walls 20 and end walls 22 of the receptacle are recessed on their upper section 24 to form a step 26 which provides a seat for the cover 30. Both the side and end walls are angularly inclined outward with respect to the top in correlation with the base of the receptacle to provide a sloping outer surface. The cover 30 is formed with downward flange 32 around its outer sides which extends down to allow the cover to snap fit into the seat 26.

The walls of the receptacle body are provided with a plurality of internal rib members 40 which extend inward from the inner surface of the end and side walls of the receptacle to terminate in the outer wall 42 and bottom 43 of an oblong curved bristle housing 44 which defines a finger chamber 45. The rib members 40 provide strength and stability to the receptacle 12 and allow it to be stably seated on a flat surface when fingers are inserted into the receptacle. One wall 46 of the oblong curved bristle housing has formed on its inner curved surface 48 a plurality of spaced rows of bristles 50 which extend inward into the chamber 45. The front or upper bristle section 52 preferably consists of rows of forty individual triangular shaped bristle members which are four deep (have a width of four bristles but can range from four to eight bristles) and are individually spaced apart. The back or lower bristle section 56 consists of rows of forty individual triangular shaped bristle members which are ten deep (have a width of ten bristles but can range from eight to twelve bristles) and are individually spaced apart. However, the bristle member rows can range in number from 20 to 60 depending on the finger engagement desired. The bristle sections 52 and 56 are separated from each other by a wall section 54 which allows free flow of the remover solution and a cuticle safe area. A small space 58 is provided between the last row of bristles in bristle section 56 and the bottom 43. The bristle members preferably extend into the chamber 45 a distance which is about one half the width W of the chamber opening or slightly less allowing easy entry of the fingers while still providing firm engagement of the bristles with the fingernail.

In the present invention there are parallel rows of forty bristles equally spaced so that they project inward toward the center of the chamber 45 of the oblong bristle housing. However, as noted, the number of rows as well as the depth or width of the same can increase or decrease as desired. The space between the bristle sections and the rows of bristles allow nail remover or conditioner placed within the receptacle to freely flow into and out of the brush area. The brush because of its plastic construction has no metal parts or sponge-like foam to trap bacteria or virus.

The entire construction of the container and integral brush structure is preferably polyethylene and permits the fingers to be inserted and withdrawn from the interior of the brush member. The composition of the brush structure and receptacle is such that is virtually impervious to the deleterious effects of nail remover in both liquid and vapor phase.

When nail remover solvent or conditioner is added to or contained within the receptacle, the fingers are placed down into the brush member so that the brush bristles engage the hardened polish on the fingernail to abrade or fracture the surface of the polish. This fracturing in connection with additional bristles engaging the polish and artificial nails in combination with the remover solvent removes the polish from the nail surface and the artificial finger nails from the natural finger base. Upon removal of the fingers from the receptacle, the bristles spring back to their previous memory position.

If desired, the solvent material, removed nails and associated materials can be emptied from the receptacle and the receptacle washed out as desired and reused in any manner desired to provide optimum cleanliness and hygiene.

In the foregoing description, the invention has been described with reference to a particular preferred embodiment, although it is to be understood that specified details shown are merely illustrative, and the invention may be carried out in other ways without departing from the true spirit and scope of the following claims:

What is claimed:

1. A manicuring device adapted for selectively cleaning or removing artificial fingernails from a plurality of fingers comprising a plastic, integrally molded container body with an inner structure defining a chamber, said inner structure being constructed with a closed bottom portion and side wall means secured to said bottom portion to define an opening of sufficient width and length to receive a plurality of fingers, said side wall means being provided with a plurality of rib members extending into said chamber and secured to a bristle housing, said bristle housing being positioned within said chamber and including a flexible brush means integrally molded thereto comprising a plurality of bristles spaced in a plurality of rows extending inward from said bristle housing and defining a curved passageway allowing fingers to pass therethrough engaging said bristles, and a cover removably mounted to said container body.

2. A manicuring device as claimed in claim 1 wherein said container body has connected end and side walls which are angularly inclined outward from the top surface of the container body.

3. A manicuring device as claimed in claim 1 wherein said bristle housing contains two bristle sections separated from each other.

4. A manicuring device as claimed in claim 3 wherein said bristle sections comprise a front section and a rear section, said front section being provided with a smaller depth of bristles than said rear section.

5. A manicuring device as claimed in claim 4 wherein said bristle front section ranges from 40 to 60 bristles in length and 4 to 8 bristles in depth.

6. A manicuring device as claimed in claim 4 wherein said bristle rear section ranges from 40 to 60 bristles in length and 8 to 12 bristles in depth.

7. A manicuring device as claimed in claim 1 wherein said container body is rectangularly shaped and recessed in its top portion to form a seat for said cover.

8. A manicuring device as claimed in claim 1 wherein said container body is provided with end side panels which are secured to the top of said container body to partially cover said inner structure opening.

9. A manicuring device adapted to remove artificial fingernails from the fingers of a user comprising a plastic integrally molded container body with an inner bristle housing secured to the container body and supported by a plurality of rib members which connect said container body and said inner bristle housing, said inner bristle housing defining a chamber with an opening of sufficient width and length to receive a plurality of fingers, at least one wall of said inner bristle housing containing a flexible brush means integrally molded thereto, said flexible brush means comprising a plurality of bristle sections extending inward from the inner surface of the wall into said chamber and defining a curved passageway allowing plurality of fingers to pass therethrough and engage said bristle sections, said bristle sections each comprising a plurality of bristle members spaced in a plurality of rows and cover means removably mounted to said container.

10. A manicuring device as claimed in claim 9 wherein said container body is of a rectangular configuration and has connected end and side walls which extend angularly outward from the top surface of the container body.

11. A manicuring device as claimed in claim 9 wherein each of said container body end and side walls is secured to said inner bristle housing by a plurality of integrally molded rib members.

12. A manicuring device as claimed in claim 9 wherein said bristle housing contains two bristle sections separated from each other by a planar surface.

13. A manicuring device as claimed in claim 12 wherein said bristle sections comprise a front section and a rear section, said front section being provided with a smaller depth of bristles than said rear section.

14. A manicuring device as claimed in claim 13 wherein said bristle front section ranges from 40 to 60 bristles in length and 4 to 8 bristles in depth.

15. A manicuring device as claimed in claim 13 wherein said bristle rear section ranges from 40 to 60 bristles in length and 8 to 12 bristles in depth.

16. A fingernail removing device adapted to remove artificial fingernails from the fingers of a user comprising a plastic, integrally molded rectangular container body with an inner bristle housing secured and supported by a plurality of integral rib members to the rectangular container body, said inner bristle housing having an oblong configuration defining a chamber with an opening of sufficient width to receive a plurality of fingers, one wall of said bristle housing containing a flexible brush means integrally molded to the inner surface of said wall, said flexible brush means comprising at least two separated sections of bristles, each section of bristles comprising a plurality of spaced bristle members extending inward from the inner surface of the bristle housing wall into said chamber and defining a curved passageway allowing plurality of fingers to pass therethrough while allowing said fingers to engage said bristle members, said bristle members being spaced in a plurality of rows positioned around an inner curved inner surface of the bristle housing and cover means removably mounted to said container.

17. A manicuring device as claimed in claim 16 wherein said bristle members are triangular in shape and of a length which is less than one half the width of the bristle housing chamber opening.

18. A manicuring device as claimed in claim 16 wherein said bristle members are triangular in shape and of a length which is about one half the width of the bristle housing chamber opening.

19. A manicuring device adapted to selectively clean or remove artificial fingernails from a plurality of fingers of a user comprising a plastic, integrally molded container body with an inner bristle housing secured to the container body, said inner bristle housing having an oblong configuration with curved walls defining a chamber with an elongated opening of sufficient width to receive a plurality of fingers, at least one wall of said bristle housing containing a flexible brush means with spaced bristle members molded to an inner surface of said wall, said bristle housing defining a curved passageway allowing plurality of fingers to pass therethrough while allowing said fingers to engage said bristle members.

* * * * *